US005606778A

United States Patent [19]

Jungkind

[11] Patent Number: 5,606,778

[45] Date of Patent: Mar. 4, 1997

[54] SHOE CLOSURE

[75] Inventor: Roland Jungkind, Garmisch-Partenkirchen, Germany

[73] Assignee: PUMA AG Rudolf Dassler Sport, Germany

[21] Appl. No.: 446,732

[22] PCT Filed: Nov. 28, 1993

[86] PCT No.: PCT/DE93/01140

§ 371 Date: Jun. 5, 1995

§ 102(e) Date: Jun. 5, 1995

[87] PCT Pub. No.: WO94/13165

PCT Pub. Date: Jun. 23, 1994

[30] Foreign Application Priority Data

Apr. 12, 1992 [DE] Germany ..... 42 40 916.0

[51] Int. Cl.[6] ..... A43C 11/00

[52] U.S. Cl. ..... 24/68 SK

[58] Field of Search ..... 24/68 R, 68 SK, 24/69 SK, 70 SK, 71 SK, 71.1; 36/50.5, 50.1

[56] References Cited

U.S. PATENT DOCUMENTS 4,433,456 2/1994 Baggio .

4,748,726 6/1988 Schoch .

4,961,544 10/1990 Bidoia .

*Primary Examiner*—James R. Brittain

*Attorney, Agent, or Firm*—Sixbey, Friedman, Leedom & Ferguson, P.C.; David S. Safran

[57] ABSTRACT

A shoe closure, consisting of a rope pulley mounted rotatably in a bearing element to wind up at least one ropelike tightening element to close the shoe, a rotating element to actuate the rope pulley and a reducing gear between rotating element and rope pulley in the form of an eccentric drive, is to be improved so that no nonuniform tightening or pulling movements of the tightening element occur. This is achieved in that rope pulley (3) is designed as an independent unit mounted rotatably concentrically to central axis (9). Eccentric knob (10) is mounted movably parallel to rope pulley (3) and is movable, by eccentric driving pin (12), in a plane parallel to rope pulley (3). Eccentric knob (10) has one or more sector or sectors (16) on a circle (14) concentric to its axis of rotation (13), sector or sectors whose center or centers (15) lies or lie on concentric circle (14) and whose double radius ($r_K$) is at least approximately equal to the sum of diameter (D) of a coupling pin (17) attached to rope pulley (3) and diameter ($D_K$) of circular path (18) of eccentric driving pin (12) (FIG. 1 ).

11 Claims, 3 Drawing Sheets

SHOE CLOSURE

FIELD OF THE INVENTION

This invention relates to a shoe closure having a grooved roller mounted rotatably in a bearing element to wind up at least one rope-like tightening element to close the shoe, a rotating element to actuate the grooved roller and a reducing gear between the rotating element and the grooved roller in the form of an eccentric drive. In particular, to such a closure in which an eccentric sliding drive gear is coupled with the grooved roller and can be driven by the rotating element, the eccentric sliding drive gear being mounted on an eccentric driving pin that has a periphery toothing that connects with a countertoothing of a housing wall placed concentrically to the central axis of the rotating element surrounding the eccentric knob.

DESCRIPTION OF RELATED ART

There, a self-locking eccentric gear is provided as a reducing gear. In this case, the rope pulley is placed directly on the eccentric driving wheel and takes part in the eccentric movement of the eccentric driving wheel when tightening and loosening the tightening element. In this way, nonuniform tightening or pulling movements result.

SUMMARY OF THE INVENTION

With this invention, the object is to be achieved to improve the known shoe closures so that nonuniform tightening or pulling movements of the tightening element or tightening elements no longer occur.

This object is achieved by the features that the grooved roller is designed as an independent unit rotatably mounted concentrically with respect to a central axis and the eccentric sliding drive gear is mounted to move parallel to the grooved roller by an eccentric driving pin in a plane parallel to the grooved roller and has one or more circular openings, the center(s) of which lie on a circle that is concentric to its axis of rotation, and twice the radius of the circular openings is at least approximately equal to the sum of diameter of a coupling pin attached to the grooved roller and a diameter of the circular path of the eccentric driving pin.

This invention is distinguished especially in that a completely uniform rotation corresponding to the rotation of the rotating element is achieved by the separate arrangement of the rope pulley and by its drive by the one or more circular openings of the eccentric sliding drive gear. The desired reduction is produced from the selected number of teeth of the gear drive. As a result, a very sensitive adjustment of the closing pressure of this shoe closure according to the invention is possible.

Especially advantageous is that the eccentric drive can be designed so that—in contrast to the previously known solution—it is self-locking in both directions.

Also advantageous is that between one of the rotatable parts and a stationary housing part or a part fastened or fastenable to the housing part, catching elastic means are provided that catch, in a locking way, in every adjusted rotary position, but whose locking action can be overcome to change the rotary position by a torque acting on the rotating element.

Other advantageous details of the invention are based on the embodiments illustrated in the drawings.

DETAILED DESCRIPTION OF THE DRAWINGS

Figure 1:
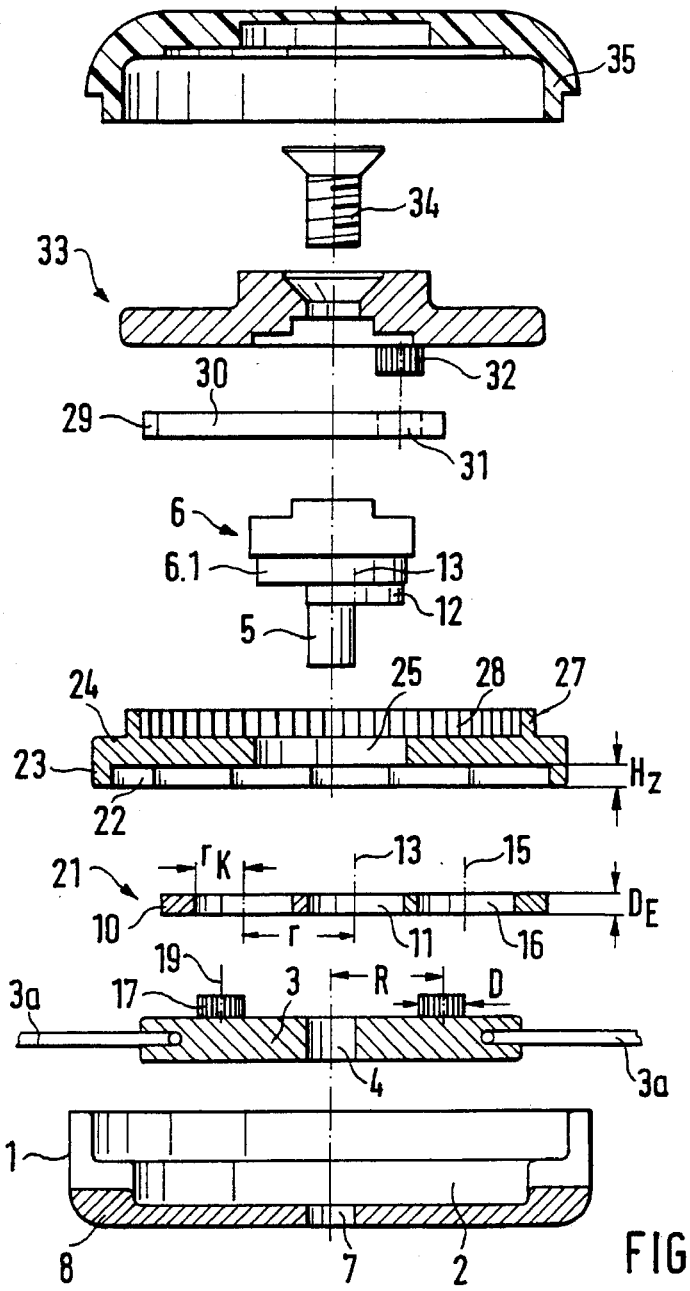
FIG. 1 shows the arrangement of the individual parts of the shoe closure according to the invention as an exploded view.
Figure 2:
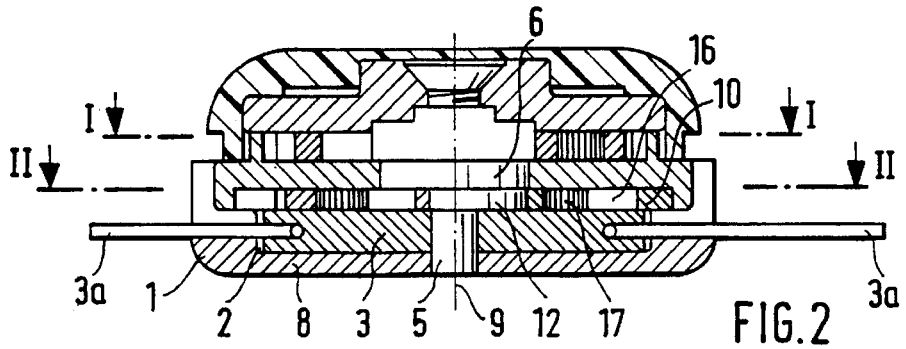
FIG. 2 shows the shoe closure according to claim 1 in the assembled state, viewed respectively from the side and in section.
Figure 3:
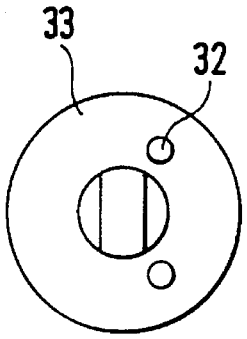
FIG. 3 is a top view of a rotating element of the shoe closure.

According to FIGS. 1 and 2, the shoe closure according to the invention has a housing part 1, with a circular recess 2 for receiving a rope pulley 3 and ropelike tightening element or tightening elements 3*a*. The insertion of rope-shaped tightening element or tightening elements (3*a*) into rope pulley 3 takes place by feed slots 3*b*, known in the art, in rope pulley 3. Rope pulley 3 has a central hole 4, through which a bearing pin 5 of an axle unit 6 engages and ends in a bearing hole 7 of bottom 8 of housing part 1. The axis of bearing pin 5 simultaneously forms central axis 9 of the shoe closure.

Figure 7:
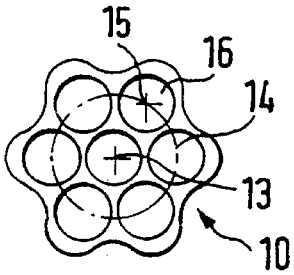
FIG. 7 is a top view of the eccentric sliding drive gear.
Figure 8:
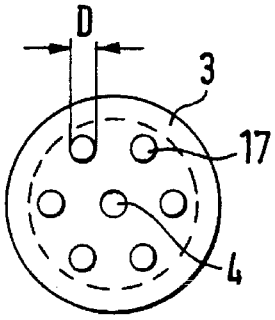
FIG. 8 is a top view of a grooved roller of the shoe closure.
Figure 9:
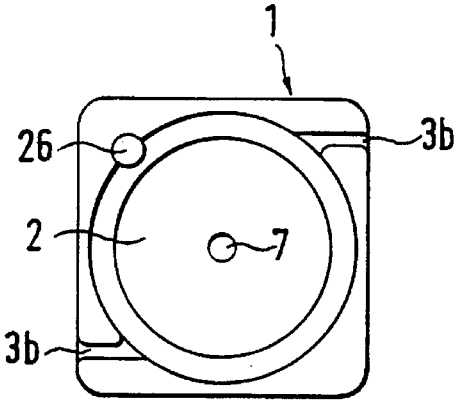
FIG. 9 is a top view of a housing part of the shoe closure.
Figure 10:
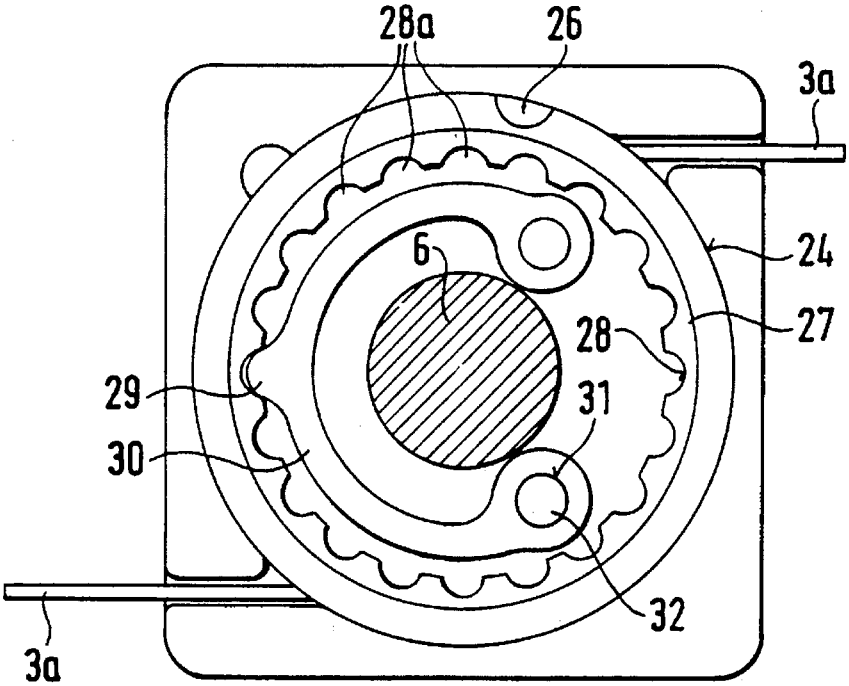
FIG. 10 is a view along section I—I of FIG. 2

An eccentric sliding drive gear 10 lies on rope pulley 3. Eccentric sliding drive gear 10 has a central bearing hole 11, with which it is rotatably mounted on an eccentric driving pin 12 of axle unit 6 placed eccentrically to central axis 9. Center 15 of several circular openings 16, six here as an embodiment, in each of which a respective coupling pin 17 of rope pulley 3 engages, lies respectively on a circle 14 (FIG. 7) concentric to axis of rotation 13 of eccentric driving pin 12. The angular position of circular openings 16 corresponds to that of coupling pins 17. Circular openings 16 are preferably offset relative to one another in each case by the same angle, which in the embodiment shown is around 60°. A single circular opening 16, in operative connection with only one coupling pin 17, would basically also be sufficient.

Figure 11:
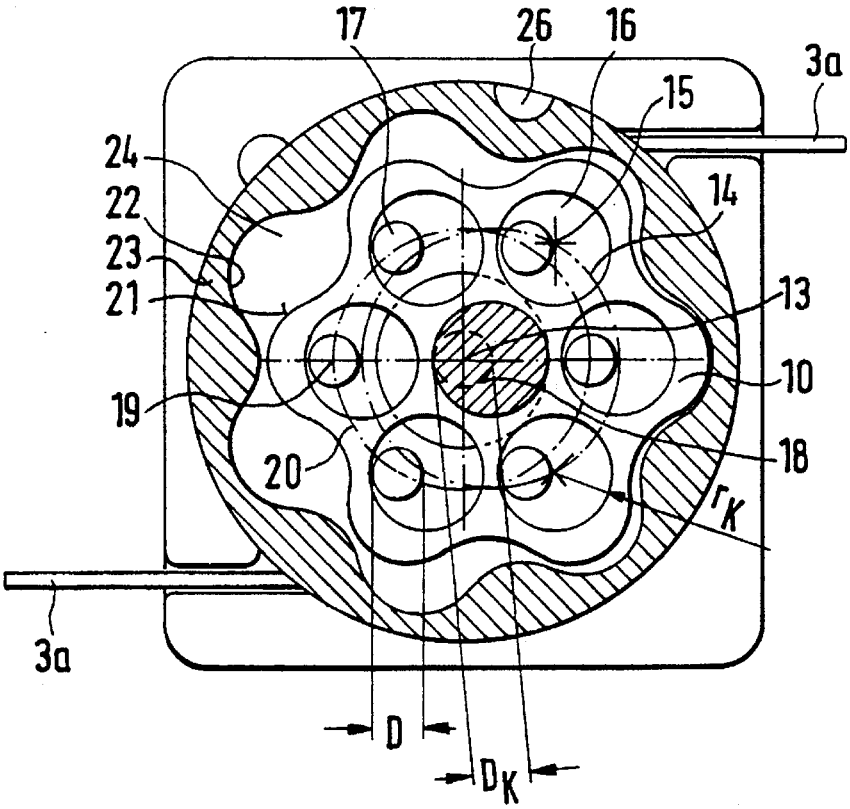
FIG. 11 is a view along section II—II of FIG. 2.

By rotating axle unit 6 around central axis 9, axis of rotation 13 of eccentric driving pin 12 describes a circular path 18 concentric to central axis 9 (FIG. 11). Centers 19 of coupling pins 17 lie on a centering circle 20 concentric to central axis 9 (FIG. 11).

The outside contour of eccentric sliding drive gear 10 forms a toothing 21 that can roll on an inside contour, made as countertoothing 22, of a collar 23, projecting downward on one side, of a disk 24 overlapping eccentric sliding drive gear 10. Disk 24 has a central hole 25, with which the latter is rotatably mounted on axle unit 6 concentrically to central axis 9. Disk 24 further has one or more fastening means 26, by which it can be unrotatably fastened to housing part i in one or more rotary positions. In this respect, FIGS. 5, 6, 10 and 11 are pointed out.

On the side opposite collar 23, disk 24 has another collar 27 projecting upward. The latter forms a catching ring 28 by its inside contour (see FIG. 10), against which a catching projection 29 of a stop spring 30 rests elastically and in a catching way. Stop spring 30, for its part, is fastened by fastening lugs 31 to holding pins 32 of a rotating element 33 overlapping disk 24. Rotating element 33 is connected, for example, by a screw 34 to axle unit 6 or consists, with the latter, of a structural unit. Rotating element 33 is also provided with a preferably elastic cover 35, which preferably is used as an actuating element of this shoe closure.

To obtain a reducing gear free from play, radius $r_K$ of opening 16 can be equal or at least approximately equal to diameter $D_K$ of circular path 18 of eccentric driving pin 12.

Diameter D of coupling pins 17 is basically freely selectable within certain limits, which also applies for diameter $D_K$ of circular path 18 of eccentric driving pin 12.

Consequently, there applies in each case the formula:

$2 \times r_K = D + D_K$, plus a minimum play of approximately 0.05 mm to 0.1 mm.

This means that two times radius $r_K$ of opening 16 is approximately equal to the sum of diameter D of coupling pins 17 and diameter $D_K$ of circular path 18 of eccentric driving pin 12.

Height $H_Z$ of countertoothing 22 is at least approximately equal to thickness $D_E$ of eccentric knob 10.

Figure 4:
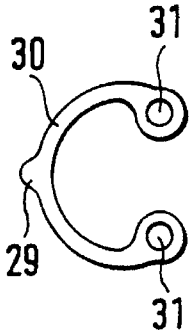
FIG. 4 is a top view of a stop spring the shoe closure.
Figure 5:
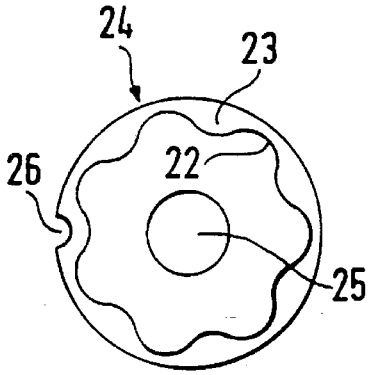
FIG. 5 is a bottom view of a disk of a rotating element of the shoe closure.
Figure 6:
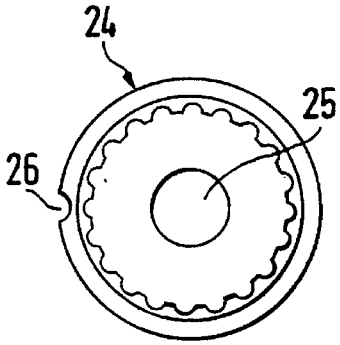
FIG. 6 is a top view of the disk shown in FIG. 5.

In FIG. 4, stop spring 30 is represented with only one catching projection 29. But two or more catching projections, preferably distributed uniformly over this spring part, can also be provided.

Optionally, two or more ropelike tightening elements also can be used to close the shoe.

The configuration, self-locking in both directions of rotation, of eccentric drive 6, 10, 17 is made in that indentations 28*a* of catching ring 28 are designed symmetrically relative to catching projection or catching projections 29 independently of the direction of rotation. The torque necessary for the bridging of the locking action can be controlled to the greatest possible extent by the number and the shape of indentations 28*a* and catching projection or catching projections 29.

Bearing pins 5, eccentric driving pins 12 and bearing axle shoulder 6.1 seen from FIG. 1 are designed as axle unit 6. This axle unit 6 is tightly connected to rotating element 33, 35 or forms a structural unit with the latter.

I claim:

1. Shoe closure comprising a grooved roller rotatably mounted on a bearing element for winding and unwinding at least one rope-like tightening element to open and close a shoe, a rotating element for actuating the grooved roller and a reducing gear between the rotating element and the grooved roller in the form of an eccentric drive having an eccentric drive gear which is coupled with the grooved roller, which is driven by the rotating element, which is supported on an eccentric drive pin, and which has a peripheral toothing which interacts with a countertoothing of a wall of a housing part surrounding the eccentric drive gear; wherein the grooved roller is an independent unit co-axially disposed with respect to a central axis of the rotating element; wherein the eccentric drive gear is supported to slide in a plane that is parallel to the grooved roller about the eccentric drive pin; and wherein the eccentric drive gear has at least one circular opening with a center point which lies on a circle which is concentric with respect to an axis of rotation of the eccentric drive gear; wherein the grooved roller has at least one coupling pin projecting therefrom into a respective circular opening of the eccentric drive gear; and wherein twice the radius of the circle on which the circular opening lies is at least approximately equal to the sum of a diameter of the coupling pin in the circular hole and a diameter of a circular path of the eccentric drive pin.

2. Shoe closure according to claim 1, wherein the eccentric drive gear has a plurality of circular openings spaced uniformly along said concentric circle; wherein the grooved roller has a plurality of coupling pins, each of which projects into a respective one of the circular openings and has a center on a centering circle which is concentric to the central axis of the rotating element and which has a radius that is equal to the radius of the circle on which the center points of the circular openings lie.

3. Shoe closure according to claim 1, wherein the eccentric drive has locking means for producing a self-locking action in both directions of rotation.

4. Shoe closure according to claim 3, wherein said locking means comprises an elastic catching means provided between the housing part and a part that is rotatable relative thereto, said catching means having a locking action which is overcome by application of a torque on the rotating element.

5. Shoe closure according to claim 4, wherein the elastic catching means comprises an annular catch rim and a catch latching means having at least one catch projection on a catch spring, the catch projection being engageable in the catch rim under elastic prestressing.

6. Shoe closure according to claim 1, wherein a fastenable part is mounted to rotate with respect to the housing part, said part being detachably fastenable to the housing part in at least one position.

7. Shoe closure according to claim 6, wherein said fastenable part comprises a disk mounted for rotation around said central axis; wherein said disk has a catching ring on a side facing the rotating element on which a catching projection of the rotating element is elastically engageable.

8. Shoe closure according to claim 7, wherein said fastenable disk is provided with a countertoothing on a side facing away from the rotating element; and wherein the eccentric drive gear is provided with a toothing and is rotatable in a space enclosed by said countertoothing around an axle unit that is engaged through a bearing hole in the disk, rotation of said eccentric drive gear being in a plane that is parallel to said disk.

9. Shoe closure according to claim 8, wherein a height of the countertoothing is at least approximately equal to a thickness of the eccentric drive gear.

10. Shoe closure according to claim 8, wherein said housing part is pot-shaped; wherein said grooved roller slidably lies on an inner bottom wall of the housing part and is rotatable around a bearing pin fastened to the housing part; wherein the eccentric drive gear is movable parallel to the grooved roller and around an eccentric driving pin which is connected to said bearing pin with the countertoothing of the fastenable eccentric drive gear meshing with the toothing of the disk; and wherein said fastenable disk is rotatably with respect to a shoulder of the bearing pin.

11. Shoe closure according to claim 10, wherein the bearing pin, eccentric driving pin and bearing pin shoulder form said axle unit, said axle unit being tightly connected with the rotating element.

* * * * *